US009181671B2

(12) United States Patent
Thomson et al.

(10) Patent No.: US 9,181,671 B2
(45) Date of Patent: Nov. 10, 2015

(54) COMPACTOR MACHINE

(71) Applicants: Brian M. Thomson, South Yorkshire (GB); Alan Keating, South Yorkshire (GB)

(72) Inventors: Brian M. Thomson, South Yorkshire (GB); David Roderick Lloyd, Yorkshire (GB); Alan Keating, South Yorkshire (GB)

( * ) Notice: Subject to any disclaimer, the term of this patent is extended or adjusted under 35 U.S.C. 154(b) by 0 days.

(21) Appl. No.: 14/357,271

(22) PCT Filed: Nov. 9, 2012

(86) PCT No.: PCT/GB2012/052788
§ 371 (c)(1),
(2) Date: May 9, 2014

(87) PCT Pub. No.: WO2013/068756
PCT Pub. Date: May 16, 2013

(65) Prior Publication Data

US 2014/0321912 A1 Oct. 30, 2014

(30) Foreign Application Priority Data

Nov. 11, 2011 (GB) ..... 1119513.8

(51) Int. Cl.
*E02D 3/026* (2006.01)
*E02D 3/032* (2006.01)
*E02D 3/046* (2006.01)

(52) U.S. Cl.
CPC ..... *E02D 3/026* (2013.01); *E02D 3/032* (2013.01); *E02D 3/046* (2013.01)

(58) Field of Classification Search
USPC ..... 404/103, 112, 117, 122, 123, 124
See application file for complete search history.

(56) References Cited

U.S. PATENT DOCUMENTS 466,771 A 1/1892 Clark
544,837 A 8/1895 Archer (Continued)

FOREIGN PATENT DOCUMENTS

WO WO2005/014938 2/2005

OTHER PUBLICATIONS

International Search Report, Application No. PCT/GB2012-052788, date of mailing Mar. 15, 2013, 2 pages.

(Continued)

*Primary Examiner* — Abigail A Risic
(74) *Attorney, Agent, or Firm* — Nixon Peabody LLP

(57) ABSTRACT

A rigid wheel (18) or roller for a compactor machine, comprising a drum for contacting material to be compacted. The drum has a profiled outer surface including a first cylindrical portion (27) and a second cylindrical portion (29). The first cylindrical portion has a larger rolling diameter than the second cylindrical portion. An inclined portion (24) extends between the first and second cylindrical portions. The area of contact between the outer surface of the drum and refuse, soil or other material to be compacted varies with the depth of penetration of the wheel into the material. The different rolling diameters within the scope of one wheel gives different ground pressures. This means that the pressure applied to the material for compaction varies depending upon the depth of penetration of the wheel. One benefit of this wheel/roller design is to allow improved go anywhere mobility—high floatation where needed changing to heavy ground pressure where conditions demand.

15 Claims, 8 Drawing Sheets

(56) References Cited

U.S. PATENT DOCUMENTS

| | | | | | |
|---|---|---|---|---|---|
| 895,230 | A | * | 8/1908 | Beier | 172/554 |
| 1,064,265 | A | | 6/1913 | Waterman | |
| 1,102,443 | A | * | 7/1914 | Schamell | 404/123 |
| 1,847,280 | A | | 3/1932 | Tomlinson | |
| 2,024,184 | A | | 12/1935 | Ritchie | |
| 2,410,465 | A | * | 11/1946 | Small | 404/121 |
| 2,509,675 | A | * | 5/1950 | Cox | 404/124 |
| 2,703,515 | A | | 3/1955 | Richards | |
| 2,755,713 | A | | 6/1956 | Harrison | |
| 2,959,231 | A | | 11/1960 | Heilman | |
| 2,978,967 | A | | 4/1961 | MacDonald | |
| 2,991,836 | A | | 7/1961 | Swanson | |
| 3,008,389 | A | * | 11/1961 | Hicks | 404/130 |
| 3,080,799 | A | | 3/1963 | Calfee | |
| 3,128,831 | A | | 4/1964 | Arndt | |
| 3,303,799 | A | | 2/1967 | Sharper | |
| 3,318,209 | A | * | 5/1967 | Schultz | 404/121 |
| 3,426,660 | A | * | 2/1969 | Scott | 404/117 |
| 4,438,819 | A | * | 3/1984 | Ryals | 172/536 |
| 4,610,567 | A | | 9/1986 | Hosking | |
| 4,702,643 | A | | 10/1987 | Thilmony | |
| 4,950,102 | A | | 8/1990 | Zeitz | |
| 5,511,901 | A | * | 4/1996 | Yates | 404/124 |
| 5,676,493 | A | | 10/1997 | Brockway | |
| 6,095,717 | A | * | 8/2000 | Kaldenberg et al. | 404/121 |
| 6,390,204 | B1 | * | 5/2002 | Schafle | 172/554 |
| 6,554,532 | B1 | * | 4/2003 | Motz et al. | 404/117 |
| 6,991,401 | B1 | | 1/2006 | Caron | |
| 2002/0000323 | A1 | * | 1/2002 | McDonald | 172/537 |

OTHER PUBLICATIONS

International Written Opinion, Application No. PCT/GB2012-052788, date of mailing Mar. 15, 2013, 4 pages.

* cited by examiner

COMPACTOR MACHINE

CROSS REFERENCE TO RELATED APPLICATIONS

This application is a U.S. national stage of International Application No. PCT/GB2012/052788, filed Nov. 9, 2012, which claims priority to GB Application No. 1119513.8 filed on Nov. 11, 2011, both of which are incorporated herein in their entireties.

FIELD OF THE INVENTION

The present invention relates to a rigid wheel or roller for a compactor machine, and to a compactor machine having the wheel or roller.

BACKGROUND OF THE INVENTION

A compactor machine can be used to compact materials for example, but not limited to, refuse at a landfill site, or soil, gravel, etc. at a construction site.

A conventional compactor machine has wheels and/or rollers with a drum of constant outer diameter. The drum may have a smooth exterior or may have teeth (spikes, pads tips, etc.) extending therefrom. The teeth are often referred to as "sheep's feet" and aid in compression and traction due to the penetration of the smaller contacting area into the material.

SUMMARY OF THE INVENTION

The present invention provides a rigid wheel or roller for a compactor machine, comprising a drum for contacting material to be compacted, the drum having a profiled outer surface including a first cylindrical portion and a second cylindrical portion, the first cylindrical portion having a larger rolling diameter than the second cylindrical portion, and an inclined portion extending between the first and second cylindrical portions.

The construction of the wheel/roller of the present invention is such that the area of contact between the outer surface of the drum and refuse, soil or other material to be compacted varies with the depth of penetration of the wheel into the material. The different rolling diameters within the scope of one wheel gives different ground pressures. This means that the pressure applied to the material for compaction varies depending upon the depth of penetration of the wheel. The inventors of the present invention have found this to provide more efficient compaction of material. The inclined portion of the outer surface of the drum enables infinitely variable pressures. Varying the angle of inclination (with respect to the rotation axis of the wheel) of this inclined portion of the outer surface will have a further effect on the ground pressures which can be obtained. One benefit of this wheel/roller design is to allow improved go anywhere mobility—high floatation where needed changing to heavy ground pressure where conditions demand.

The construction of the wheel/roller of the present invention also means that the appropriate pressure for a certain volume of material to be compacted is applied by the wheels, without the need to change the wheels.

The angle of the inclined portion of the drum may be set at a range of angles, including but not limited to around 60° to 70° as measured from the wheel axis of rotation.

The wheel/roller preferably has a centre for coupling to an axle of the machine. The centre may be common among various wheel designs, which may include different drums.

Alternatively, the wheel/roller has a centre for coupling to a specific machine to allow retro-market fitting of the wheel/roller to existing suitable machines.

The wheel/roller is preferably hollow and may define a sealable interior volume for filling with a ballast fluid. The ballast fluid may be used to alter the ground pressure of the wheel/roller as desired. The fluid preferably may be drained from the wheel when not required. The interior volume may be bounded by the drum and the centre of the wheel.

The wheel/roller may have a welded metallic construction. The metallic material is preferably steel. However, a variety of other metallic and non-metallic materials may alternatively be used, and other wheel construction techniques other than welding may similarly be used.

The outer surface of the drum may include a plurality of first and/or second cylindrical portions, with a respective inclined portion extending between each first and second cylindrical portions.

Optionally, the drum may have further cylindrical portions of a diameter different to the diameter of the first and second cylindrical portions.

The wheel/roller may include tips (teeth) extending substantially radially outwardly from the first cylindrical portion of the drum. In use, the tips knead material to be compacted, for example soil or refuse.

The tips may be permanently fixed to the drum. Alternatively, the tips may be removably attached to the drum.

The wheel/roller may further comprise a cylindrical sleeve carrying the tips, wherein the sleeve is attached to the first cylindrical portion of the drum. The sleeve may be interchangeable upon the drum with another sleeve carrying tips selected according to the material to be compacted. The sleeve may comprise two or more sections (each defining a half-cylinder) which fit together to form the complete cylindrical sleeve.

In a second aspect the present invention provides a compactor machine having at least one wheel or roller according to the first aspect of the invention.

The compactor machine preferably has several of the wheels and/or rollers. For example, the machine may have four, six or eight wheels, or a combination of wheels and roller(s).

The compactor machine may have at least two wheels which diametrically overlap. Advantageously such overlap may be used to remove debris (e.g. refuse or soil) build-up from the wheels and therefore alleviates the need for a scraper system to clean the wheels as used on some vehicles of the prior art.

The compactor machine may be of the deadweight or vibrating type. The machine may be a self-propelling or towed vehicle.

In one embodiment, the compactor machine may have six wheels. This may provide the benefit of increased compounded effort due to a triple rolling effect over the same ground area during one machine pass compared to a conventional four wheel compactor which only has a double rolling effect or in some case only a single rolling effect.

In a third aspect the present invention provides a kit of parts for forming a wheel for a compactor machine, the kit comprising: a drum having a smooth cylindrical outer surface; two or more rigid components for installation around the drum, wherein the components each have a curved inner surface for mating with the smooth cylindrical outer surface of the drum, an outer surface for contacting material to be compacted and a plurality of tips extending substantially radially outwardly from the outer surface; and a connector for connecting the components to the drum.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
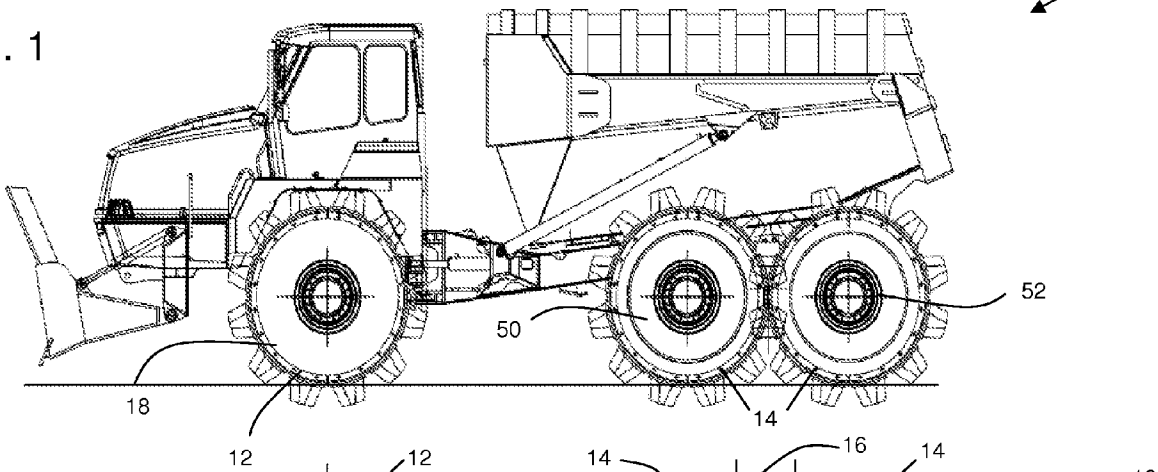
FIG. 1 shows a side view of an example of a landfill compactor vehicle having six of the wheels according to the present invention.

A compactor vehicle having wheels according to the present invention is indicated generally at 10 in FIG. 1. The vehicle 10 in this example is an articulated dump truck (ADT) that has been modified so as to be converted to a compactor. Conversion of the six-wheeled ADT vehicle 10 for compactor use includes not only replacement of the wheels for the wheels which are the subject of this invention, but also the inclusion of a front mounted blade, machine under guards to protect from debris getting tangled around any part of the drive train, etc.

In some embodiments the vehicle may be used to compact refuse for example at a landfill site, and in alternative embodiments the vehicle may be used to compact soil or any other material for compaction.

The wheels or rollers of this invention may be applied to a wide variety of compactor machinery or machinery that can be modified to be used as a compactor, including, but not limited to, any of the following vehicle types: towed deadweight single or double drum units; towed deadweight vibrating single or double drum units; self propelled single drum roller deadweight units; self propelled vibrating single drum units; four wheeled self propelled wheel deadweight rollers; self propelled four wheel vibrating rollers; or self propelled multi-wheel vibrating and deadweight units.

Figure 2:
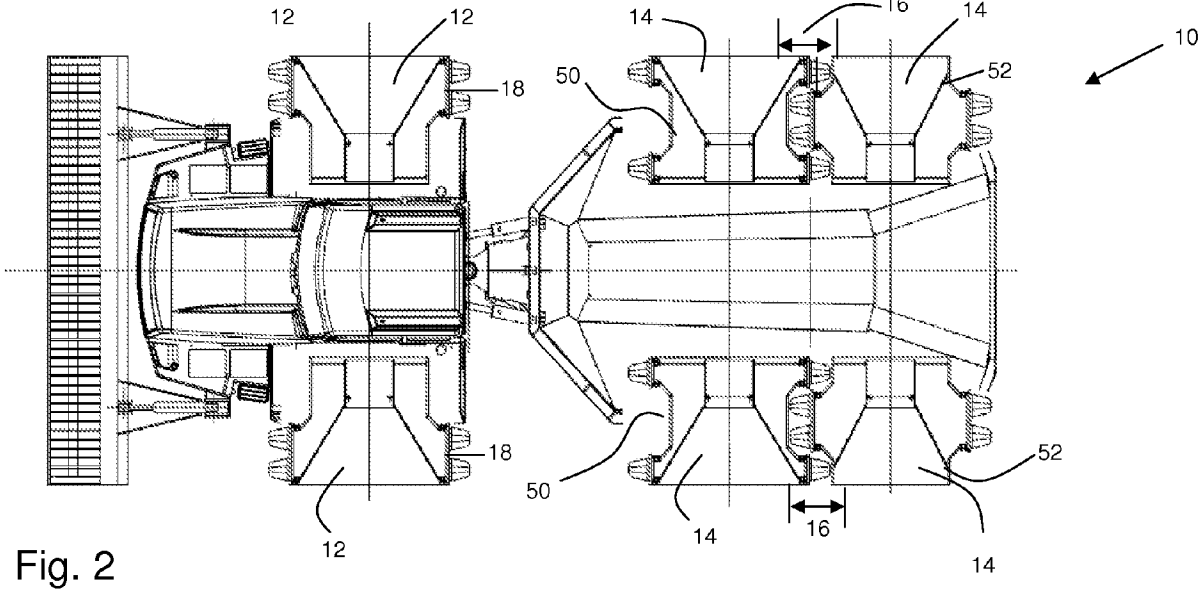
FIG. 2 shows a plan view of the vehicle of FIG. 1.

In this example, the vehicle 10 has six wheels; two front wheels 12 and four rear wheels 14. As shown in FIGS. 1 and 2, the rear wheels 14 diametrically overlap 16 so as to remove debris, for example refuse or soil, from the adjacent rear wheel which may otherwise build up. The provision of six wheels compared to four wheels (typical of conventional landfill compactor vehicles) is advantageous because it improves compaction efficiency by increased compounded effort due to a triple rolling effect over the same ground area.

Figure 3B:
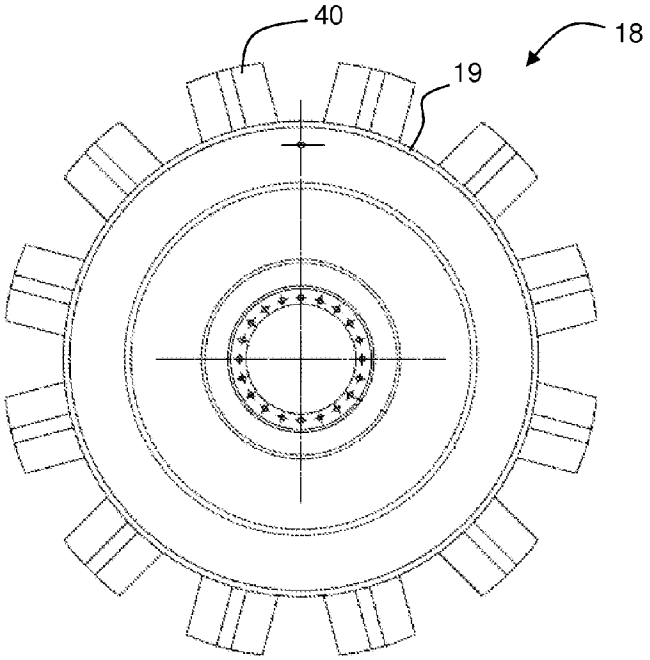
FIG. 3B shows a side view of the wheel shown in FIG. 3A.
Figure 3A:
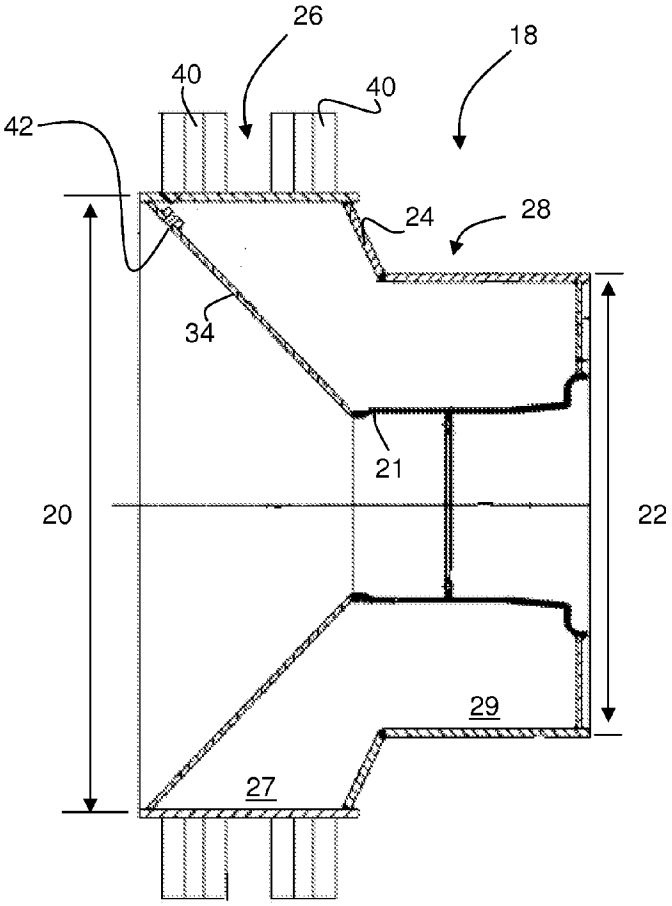
FIG. 3A shows a cross-sectional side view of a front wheel of the vehicle according to a first embodiment of the invention.

A wheel according to a first embodiment of the present invention is indicated generally at 18 in FIGS. 3A and 3B. The wheel 18 includes a drum for contacting material to be compacted, and a centre defining an inner surface 21 for coupling to an axle of the vehicle. The wheel has a welded metallic construction.

The drum is formed such that it has a first cylindrical section 27, a second cylindrical section 29 and a frusto-conical section 24. The frusto-conical section 24 is disposed between and adjacent to the first and second cylindrical sections. The first cylindrical section 27 has a rolling diameter 20 larger than the rolling diameter 22 of the second cylindrical section. The outer surface of the cylindrical sections and frusto-conical section form an outer surface 19 of the drum for contacting material to be compacted, the frusto-conical section forming an inclined surface (or lead angle) from the outer surface 26 of the first cylindrical section to the outer surface 28 of the second cylindrical section. The wheel 18 is hollow so that it can be filled with a ballast fluid between the drum and the centre of the wheel.

The construction of this embodiment of the wheel is such that when a cross-section of the wheel 18 (as shown in FIG. 3A) is viewed from left to right as shown in the figure (but from right to left in alternative embodiments) the outer surface 19 has a first portion extending in the longitudinal direction with a constant diameter (i.e. the outer surface 26 of the first cylindrical section 27). The diameter of the outer surface 19 then linearly decreases in the longitudinal direction along the inclined portion (i.e.

the outer surface of the frusto-conical section 24) to a second portion of constant diameter (i.e. the outer surface 28 of the second cylindrical section 29).

The outward facing side of the wheel 18 is formed with a frusto-conical recess such that it has an inclined face 34 that extends from an edge of the outer surface of the first cylindrical section to an edge of the inner surface 21 of the centre of the wheel 18. In other embodiments the recess may extend to any position nearer the centre of the wheel than the outer surface, and does not necessarily extend to the inner surface.

A plug 42 is provided in the inclined face 34 of the recess to fill (and drain) the hollow wheel with ballast fluid. The wheel defines a sealable interior volume between the drum and the centre of the wheel. The amount of liquid can be chosen to suit a given application. Preferably, the fluid will be a liquid which will not freeze in cold ambient temperatures. In other embodiments the plug may be provided in any suitable position, or multiple plugs may be provided.

Tips (teeth) 40 are arranged in two rows around the perimeter of the wheel and extend substantially radially outwardly from the outer surface of the first cylindrical section 27 of the drum. Alternatively, the tips may be inclined (at a small angle) either towards or away from the direction of forward rotation of the wheel, or towards or away from the vehicle body. The tips are of the "sheep's feet" type, but may alternatively take any suitable form. In this example the tips 40 are permanently fixed to the drum, e.g. by welding. Alternatively, the tips may be removably attached to the drum, e.g. by bolting.

Figure 7B:
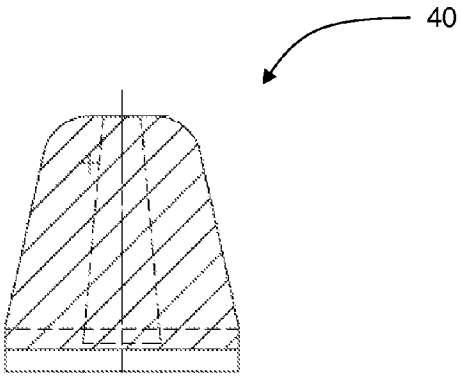
FIG. 7B shows a front view of the tip of FIG. 7A.
Figure 7A:
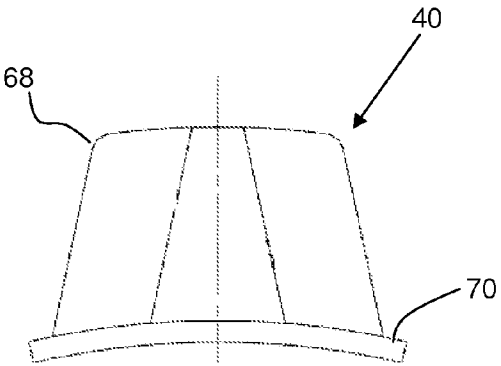
FIG. 7A shows a side view of a tip suitable for use on the wheel or detachable feet of any one of FIGS. 3 to 6.
Figure 7C:
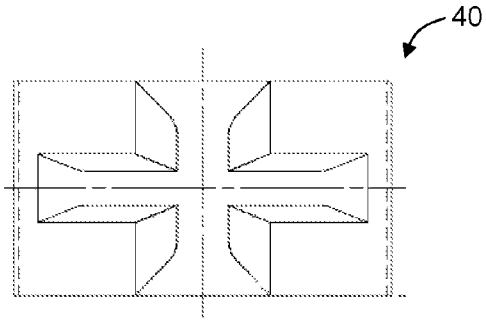
FIG. 7C shows a plan view of the tip of FIGS. 7A and 7B.

Referring to FIGS. 7A to 7C, an alternative tip 40*b* is shown. In this alternative embodiment the tip 40*b* protrudes from a base 70 that is attachable to a wheel or a further component that is attachable to a wheel, an example of which is described later. The tip 40*b* is shaped in the form of a cross. The sides of the tip are inclined and the edges 68, that in use initially contact the ground, are chamfered.

In alternative embodiments the wheel/roller may not comprise tips, in some such cases the exterior surface of the wheel/roller may be corrugated with any suitable additional pattern.

Figure 4B:
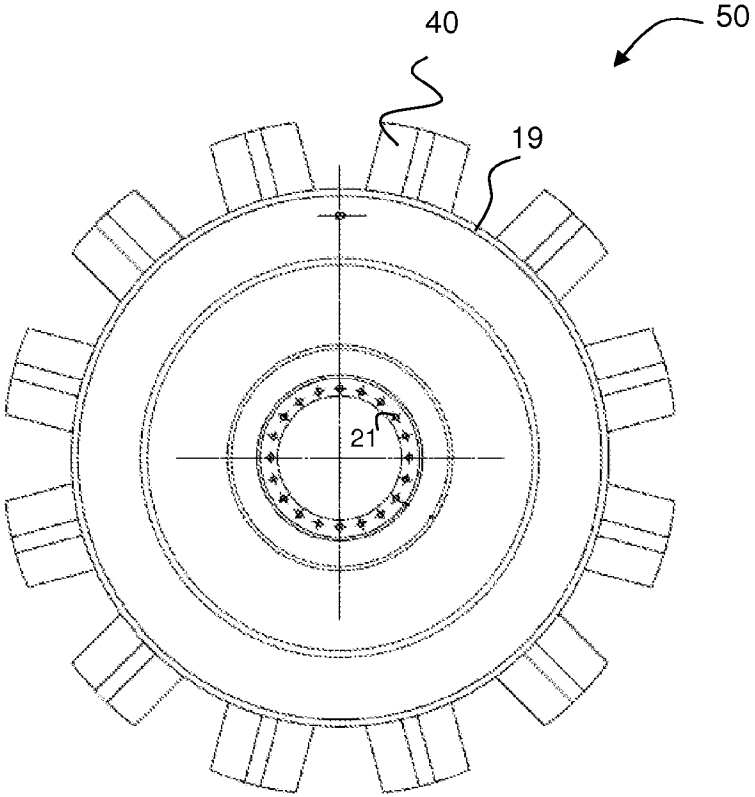
FIG. 4B shows a side view of the wheel shown in FIG. 4A.
Figure 4A:
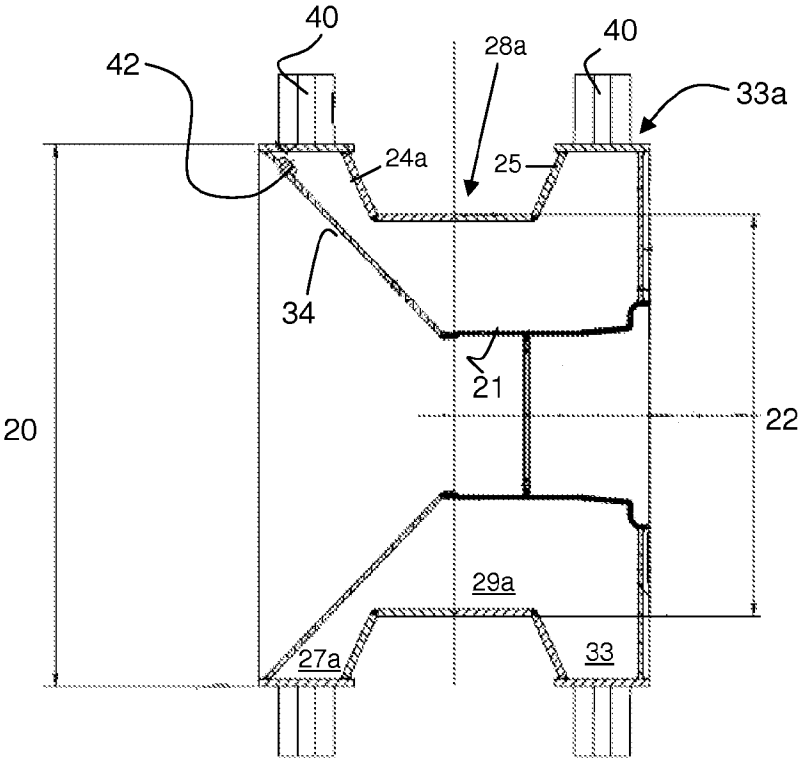
FIG. 4A shows a cross-sectional side view of a rear wheel of the vehicle according to a second embodiment of the invention.

A wheel according to a second embodiment of the present invention is indicated generally at 50 in FIGS. 4A and 4B. Only the differences between the wheel 50 and the wheel 18 will be described in the following and like reference numerals have been used to denote like parts.

The drum of the wheel 50 is formed such that it has a first cylindrical section 27*a*, a second cylindrical section 29*a*, a third cylindrical section 33 and two frusto-conical sections 24*a*, 25. The second cylindrical section 29*a* is positioned between the first and the third cylindrical sections 27*a*, 33. One of the frusto-conical sections 24*a* is positioned between and adjacent to the first and second cylindrical sections 27*a*, 29*a* and the other frusto-conical section 25 is positioned between and adjacent to the second and third cylindrical sections 29*a*, 33.

The outer surface of the cylindrical sections and frusto-conical sections form an outer surface 19*a* of the drum for contacting material to be compacted, the frusto-conical section 24*a* forming an inclined surface (or lead angle) from the outer surface 26*a* of the first cylindrical section 27*a* to the outer surface 28*a* of the second cylindrical section, and the frusto-conical section 25 forming an inclined surface (or lead angle) from the outer surface 28*a* of the second cylindrical section 29*a* to the outer surface 31 of the third cylindrical section 33.

The rolling diameters 20*a* of the first and the third cylindrical sections are equal and larger than the rolling diameter 22*a* of the second cylindrical section.

The construction of this embodiment of the wheel is such that when a cross-section of the wheel 50 (as shown in FIG. 4A) is viewed from left to right as shown in the figure (but from right to left in alternative embodiments) the outer surface 19*a* has a first portion extending in the longitudinal direction with a constant diameter (i.e. the outer surface 26*a* of the first cylindrical section 27*a*). The diameter of the outer surface 19*a* then linearly decreases in the longitudinal direction along a first inclined portion (i.e. the outer surface of the frusto-conical section 24*a*) to a second portion of constant diameter (i.e. the outer surface 28*a* of the second cylindrical section 29*a*). The diameter of the outer surface 19*a* then linearly increases in the longitudinal direction along a second inclined portion (i.e. the outer surface of the frusto-conical section 25) to a third portion of constant diameter (i.e. the outer surface 31 of the third cylindrical section 33).

In this embodiment the two rows of tips (teeth) 40 are arranged around the perimeter of the wheel with one row extending substantially radially from the outer surface of the first cylindrical section 27*a* and the other row extending radially from the outer surface of the third cylindrical section 33.

Figure 5B:
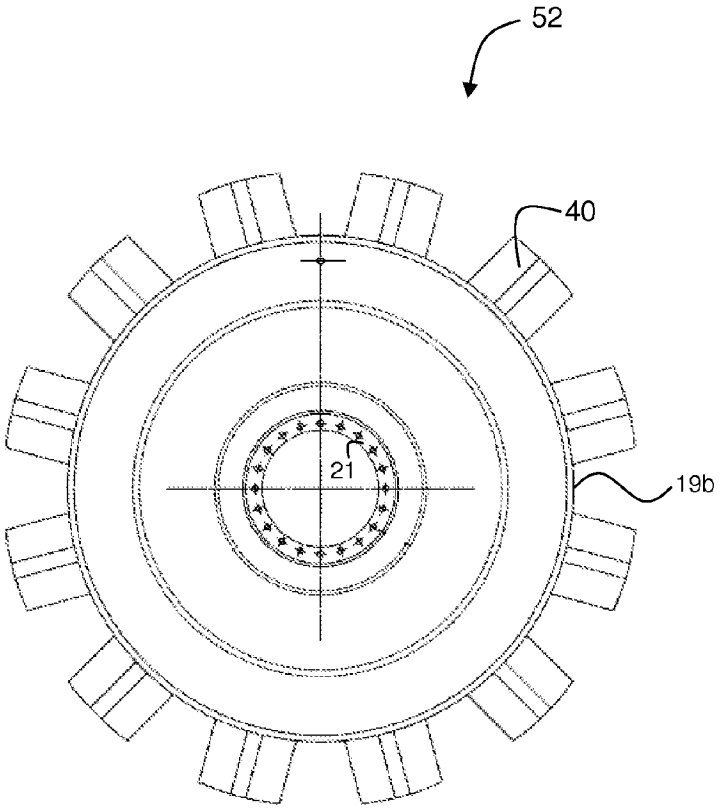
FIG. 5B shows a side view of the wheel shown in FIG. 5A.
Figure 5A:
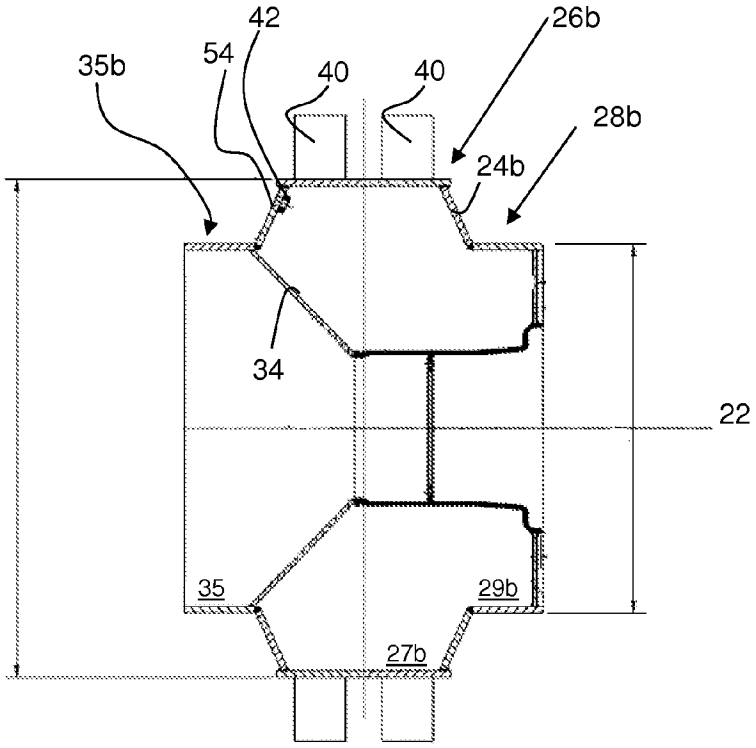
FIG. 5A shows a cross-sectional side view of a rear wheel of the vehicle according to a third embodiment of the invention.

A wheel according to a third embodiment of the present invention is indicated generally at 52 in FIGS. 5A and 5B. Only the differences between the wheel 52 and the wheel 18 will be described in the following and like reference numerals have been used to denote like parts.

The drum of the wheel 52 is formed such that it has a first cylindrical section 27*b*, a second cylindrical section 29*b*, a third cylindrical section 35 and two frusto-conical sections 24*b*, 54. One of the frusto-conical sections 54 is positioned between and adjacent to first and third cylindrical sections 27*b*, 35 and the other frusto-conical section 24*b* is positioned between and adjacent to the first and second cylindrical sections 27*b*, 29*b*.

The rolling diameter 20*b* of the first cylindrical section 27*b* is larger than the rolling diameter 22*b* of the second and third cylindrical sections 29*b*, 35.

The outer surface of the cylindrical sections and frusto-conical sections form an outer surface 19*b* of the wheel for contacting material to be compacted. One frusto-conical section 54 forms an inclined surface (or lead angle) from an outer surface 35*b* of the third cylindrical section 35 to the outer surface 26*b* of the first cylindrical section 27*b*, and the other frusto-conical section 24*b* forms an inclined surface (or lead angle) from the outer surface 26*b* of the first cylindrical section 27*b* to the outer surface 28*b* of the second cylindrical section 29*b*.

The construction of the this embodiment of the wheel is such that when a cross-section of the wheel 52 (as shown in FIG. 5A) is viewed from left to right as shown in the figure (but from right to left in alternative embodiments) the outer surface 19*b* has a first portion extending in the longitudinal direction with a constant diameter (i.e. the outer surface 35*b* of the third cylindrical section 35). The diameter of the outer surface 19*b* then increases linearly in the longitudinal direction along a first inclined portion (i.e. the outer surface of the frusto-conical section 54) to a second portion of constant diameter (i.e. the outer surface 26*b* of the first cylindrical section 27*b*). The diameter of the outer surface 19*b* then linearly decreases in the longitudinal direction along a second inclined portion (i.e. the outer surface of the frusto-conical section 24*b*) to a third portion of constant diameter (i.e. the outer surface 28*b* of the second cylindrical section 29*b*).

In this embodiment the two rows of tips (teeth) 40 are arranged around the perimeter of the wheel and extend substantially radially from the outer surface 26*b* of the first cylindrical section 27*b*.

Returning to FIGS. 1 and 2, it can be seen that the wheels 50, 52 which make up each set of rear wheels 14 of the vehicle 10 are diametrically overlapping. In particular the tips 40 of the wheels 50 diametrically overlap with the tips 40 of the wheels 52. Advantageously such overlap may be used to remove debris (e.g. refuse or soil) build-up from the wheels and therefore alleviates the need for a scraper system to clean the wheels as used on some vehicles of the prior art. As can be seen from FIG. 2, the tips 40 of the wheels 52 are arranged to sweep close to the smooth outer surface 28*a* of the smaller diameter second cylindrical section 29*a* of the wheels 50. Similarly, the tips 40 of the wheels 50 are arranged to sweep close to the smooth outer surfaces 28*b* and 35*b* of the smaller diameter second and third cylindrical sections 29*n* and 25 of the wheels 52.

Figure 8:
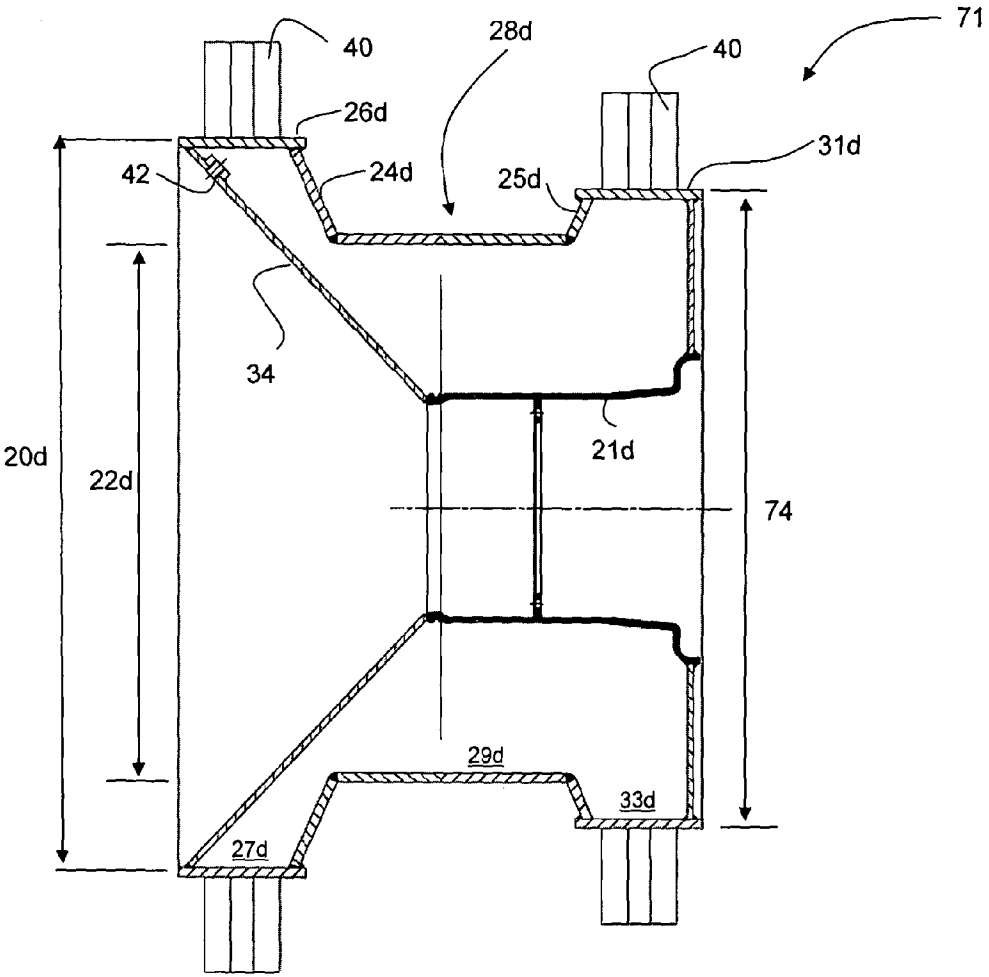
FIG. 8 shows a cross-sectional side view of a wheel according to fourth embodiment of the invention.

A wheel according to a fourth embodiment of the present invention is indicated generally at 71 in FIG. 8. Only the differences between the wheel 71 and the wheel 18 will be described in the following and like reference numerals have been used to denote like parts.

The drum of the wheel 71 is formed such that it has a first cylindrical section 27*d*, a second cylindrical section 29*d*, a third cylindrical section 33*d* and two frusto-conical sections 24*d*, 25*d*. The second cylindrical section 29*d* is positioned between the first and the third cylindrical sections 27*d*, 33*d*. One of the frusto-conical sections 24*d* is positioned between and adjacent to the first and second cylindrical sections 27*d*, 29*d* and the other frusto-conical section 25*d* is positioned between and adjacent to the second and third cylindrical sections 29*d*, 33*d*.

The outer surface of the cylindrical sections and frusto-conical sections form an outer surface of the drum for contacting material to be compacted, the frusto-conical section 24*d* forming an inclined surface (or lead angle) from the outer surface 26*d* of the first cylindrical section 27*d* to the outer surface 28*d* of the second cylindrical section 29*d*, and the frusto-conical section 25*d* forming an inclined surface (or lead angle) from the outer surface 28*d* of the second cylindrical section 29*d* to the outer surface 31*d* of the third cylindrical section 33*d*.

The rolling diameters 20*d* of the first cylindrical section is larger than the rolling diameter 74 of the third cylindrical section, and the rolling diameter of the third cylindrical section is larger than the rolling diameter 22*d* of the second cylindrical section.

The construction of this embodiment of the wheel is such that when a cross-section of the wheel 71 is viewed from left to right as shown in FIG. 8 (but from right to left in alternative embodiments) the outer surface has a first portion extending in the longitudinal direction with a constant diameter (i.e. the outer surface 26*d* of the first cylindrical section 27*d*). The diameter of the outer surface then linearly decreases in the longitudinal direction along a first inclined portion (i.e. the outer surface of the frusto-conical section 24*d*) to a second portion of constant diameter (i.e. the outer surface 28*d* of the second cylindrical section 29*d*). The diameter of the outer surface then linearly increases in the longitudinal direction along a second inclined portion (i.e. the outer surface of the frusto-conical section 25*d*) to a third portion of constant diameter (i.e. the outer surface 31*d* of the third cylindrical section 33*d*).

In this embodiment the two rows of tips (teeth) 40 are arranged around the perimeter of the wheel with one row extending substantially radially from the outer surface of the first cylindrical section 27*d* and the other row extending radially from the outer surface of the third cylindrical section 33*d*.

Figure 9:
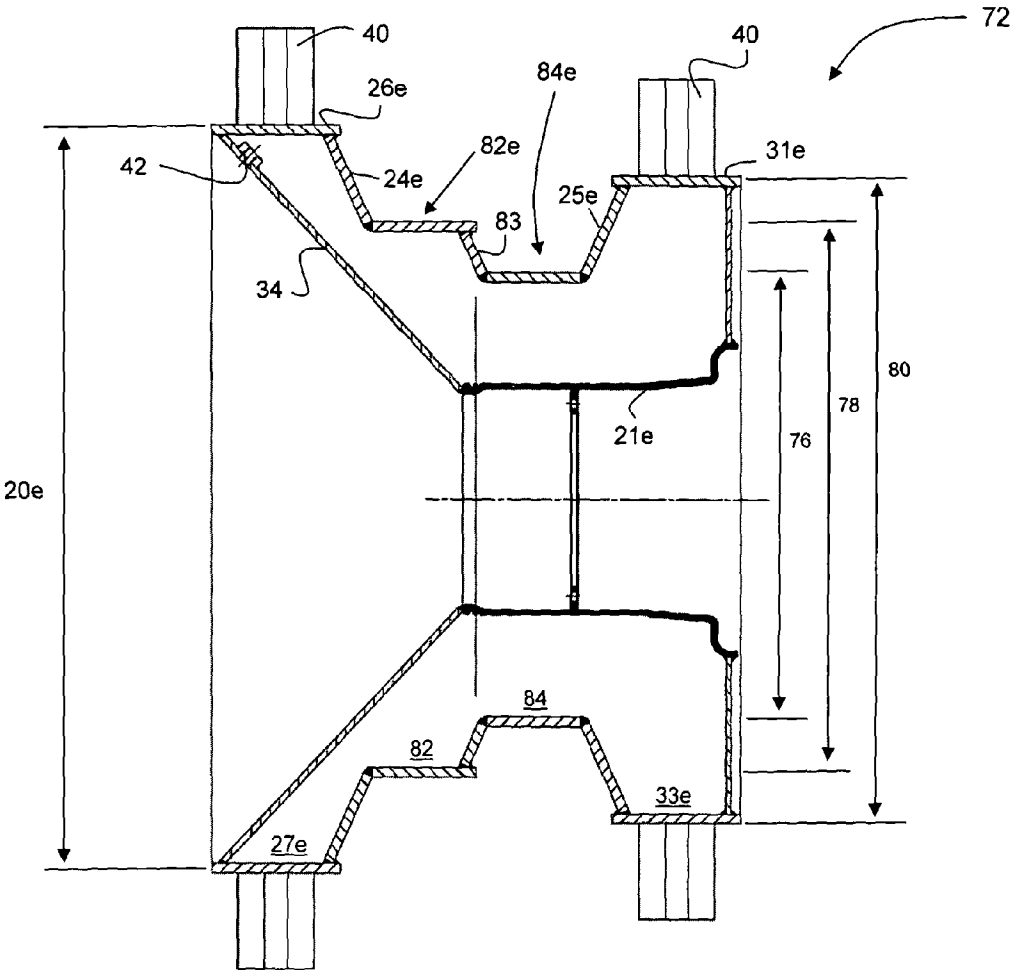
FIG. 9 shows a cross-sectional side view of a wheel according to a fifth embodiment of the invention.

A wheel according to a fifth embodiment of the present invention is indicated generally at 72 in FIG. 9. Only the differences between the wheel 72 and the wheel 18 will be described in the following and like reference numerals have been used to denote like parts.

The drum of the wheel 72 is formed such that it has a first cylindrical section 27*e*, a second cylindrical section 82, a third cylindrical section 84, and a fourth cylindrical section 33*e* and three frusto-conical sections 24*e*, 25*e* and 83. The second cylindrical section 82 is positioned between the first and the third cylindrical sections 27*e*, 84, and the third cylindrical section 84 is positioned between the second and fourth cylindrical sections 82 and 33*e*. One of the frusto-conical sections 24*e* is positioned between and adjacent to the first and second cylindrical sections 27*e*, 82, another of the frusto-conical sections 83 is positioned between and adjacent to the second and third cylindrical sections 82, 84, and the other frusto-conical section 25*e* is positioned between and adjacent to the third and fourth cylindrical sections 84, 33*e*.

The outer surface of the cylindrical sections and frusto-conical sections form an outer surface of the drum for contacting material to be compacted, the frusto-conical section 24*e* forming an inclined surface (or lead angle) from the outer surface 26*e* of the first cylindrical section 27*e* to the outer surface 82*e* of the second cylindrical section 82, the frusto-conical section 83 forming an inclined surface (or lead angle) from the outer surface 82*e* of the second cylindrical section 82 to the outer surface 84*e* of the third cylindrical section 84, and the frusto-conical section 25*e* forming an inclined surface (or lead angle) from the outer surface 84*e* of the third cylindrical section 84 to the outer surface 31*e* of the fourth cylindrical section 33*e*.

The rolling diameters 20*e* of the first cylindrical section is larger than the rolling diameter 80 of the fourth cylindrical section, the rolling diameter 80 of the fourth cylindrical section is larger than the rolling diameter 78 of the second cylindrical section, and the rolling diameter 78 of the second cylindrical section is larger than the rolling diameter 76 of the third cylindrical section.

The construction of this embodiment of the wheel is such that when a cross-section of the wheel 72 is viewed from left to right as shown in FIG. 8 (but from right to left in alternative embodiments) the outer surface has a first portion extending in the longitudinal direction with a constant diameter (i.e. the outer surface 26*e* of the first cylindrical section 27*e*). The diameter of the outer surface then linearly decreases in the longitudinal direction along a first inclined portion (i.e. the outer surface of the frusto-conical section 24*e*) to a second portion of constant diameter (i.e. the outer surface 82*e* of the second cylindrical section 82). The diameter of the outer surface then linearly decreases in the longitudinal direction along a second inclined portion (i.e. the outer surface of the frusto-conical section 83) to a second portion of constant diameter (i.e. the outer surface 84*e* of the third cylindrical section 84). The diameter of the outer surface then linearly increases in the longitudinal direction along a third inclined portion (i.e. the outer surface of the frusto-conical section 25*e*) to a fourth portion of constant diameter (i.e. the outer surface 31*e* of the third cylindrical section 33*e*).

In this embodiment the two rows of tips (teeth) 40 are arranged around the perimeter of the wheel with one row extending substantially radially from the outer surface of the first cylindrical section 27*e* and the other row extending radially from the outer surface of the fourth cylindrical section 33*e*.

The previously described embodiments advantageously provide a wheel having a construction such that the area of contact of the wheel with material to be compacted varies with the depth of penetration of the wheel into said material. The inventors of the present invention have found this to improve the efficiency of compaction. Such a profiled outer surface also means that the wheels apply an appropriate pressure for a given ground hardness without the need to change the wheel.

The ability to change the wheel tips to suit the site condition needs to be performed quickly and at low cost. This is conventionally done by changing the wheels which may involve a contractor stocking different wheels to allow this flexibility.

According to another embodiment of this invention, the larger diameter cylindrical surfaces of the wheel may be fitted with a set of interchangeable "feet", which allow different wheel tips to be introduced quickly and cost effectively simply by replacing the wheel feet as opposed to stocking and changing the complete wheel.

Figure 6B:
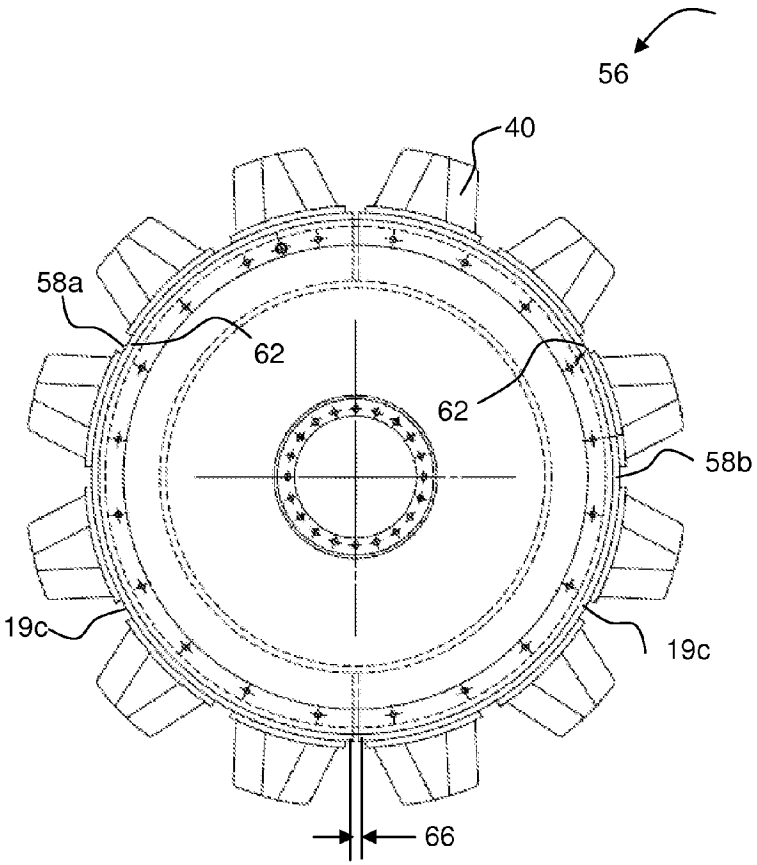
FIG. 6 shows a side view of a detachable foot in two halves for the wheel according to another embodiment of the invention.
Figure 6A:
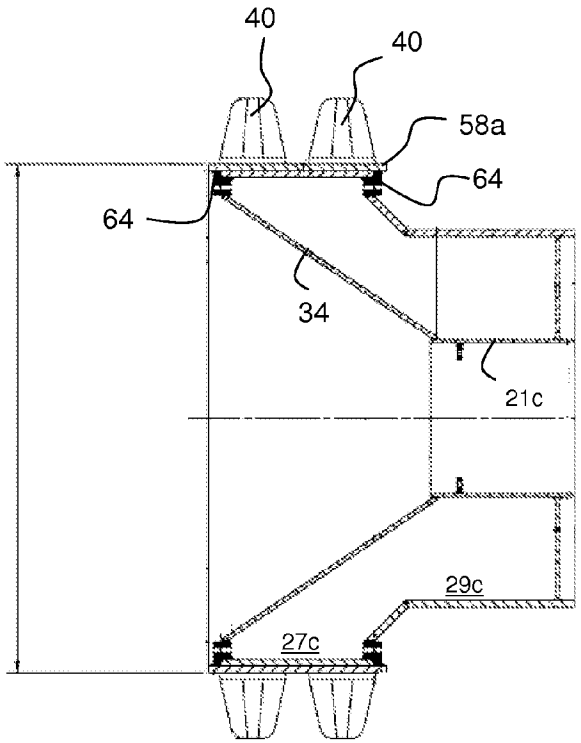

FIG. 6A and 6B illustrates an example of a set of "feet" 56 attached to a wheel. The set of feet 56 in this embodiment comprises two similar semi-circular cylindrical sleeve sections 58*a*, 58*b* carrying the tips 40. The sleeve sections 58*a*, 58*b* have an outer surface 19*c* for contacting the ground and an inner surface 62 for contact with a smooth cylindrical outer surface of the wheel. As with the wheels of the previous embodiments, the wheel shown in FIG. 6A and 6B has a first cylindrical section 27*c* and a second cylindrical section 29*c*, the first cylindrical section 27*c* having a greater diameter than the second cylindrical section 29*c*. The sleeve sections 58*a*, 58*b* are connected to the first cylindrical section by fasteners 64 spaced around the two circumferential edges of the first cylindrical section. The two sections 58*a*, 58*b* spaced apart by a distance 66 that is set so as to permit easy changing of the sleeve sections 58*a*, 58*b*.

Although the invention has been described above with reference to one or more preferred embodiments, it will be appreciated that various changes or modifications may be made without departing from the scope of the invention as defined in the appended claims.

The invention claimed is:

1. A compactor machine comprising:

a plurality of rigid wheels or rollers mounted on axles, each wheel or roller comprising a rigid drum for contacting material to be compacted, the drum having a profiled outer surface including a first cylindrical portion and a second cylindrical portion, the first cylindrical portion having a larger rolling diameter than the second cylindrical portion, and an inclined portion extending between the first and second cylindrical portions, and wherein the largest diameters of the wheels or rollers mounted on adjacent axles spaced apart along the longitudinal direction of the compactor machine are diametrically overlapping.

2. The compactor machine according to claim 1 wherein each wheel or roller further comprises a centre coupled to its axle.

3. The compactor machine according to claim 1 wherein each wheel or roller defines a sealable interior volume for filling with a ballast fluid.

4. The compactor machine according to claim 1 wherein each wheel or roller has a welded metallic construction.

5. The compactor machine according to claim 1 wherein the outer surface of the drum includes a plurality of first and/or second cylindrical portions, with a respective inclined portion extending between each first and second cylindrical portions.

6. The compactor machine according to claim 1 further comprising tips extending substantially radially from the first cylindrical portion of the drum.

7. The compactor machine according to claim 6 wherein the tips are permanently fixed to the drum.

8. The compactor machine according to claim 6 wherein the tips are removably attached to the drum.

9. The compactor machine according to claim 6 further comprising a cylindrical sleeve carrying the tips, wherein the sleeve is attached to the first cylindrical portion of the drum.

10. The compactor machine according to claim 9 wherein the sleeve is interchangeable upon the drum with another sleeve carrying tips selected according to the material to be compacted.

11. The compactor machine according to claim 9 wherein the sleeve comprises two or more sections which fit together to form the complete cylindrical sleeve.

12. A compactor machine according to claim 1 which is of the deadweight or vibrating type.

13. A compactor machine according to claim 1 which is a self-propelling or towed vehicle.

14. The compacter machine according to claim 1, wherein the profiled outer surface of each drum of each wheel or roller opposes a profiled outer surface of another drum of each wheel or roller.

15. The compactor machine according to claim 1, wherein the outer surfaces of the first cylindrical portion and the second cylindrical portion are generally flat.

* * * * *